US009412286B2

(12) United States Patent
Sundholm

(10) Patent No.: US 9,412,286 B2
(45) Date of Patent: Aug. 9, 2016

(54) FASTENING ARRANGEMENT FOR AN ELECTRONIC PRICE LABEL

(71) Applicant: MARISENSE OY, Vantaa (FI)

(72) Inventor: Göran Sundholm, Tuusula (FI)

(73) Assignee: MARISENSE OY, Vantaa (FI)

( * ) Notice: Subject to any disclaimer, the term of this patent is extended or adjusted under 35 U.S.C. 154(b) by 27 days.

(21) Appl. No.: 14/377,645

(22) PCT Filed: Feb. 6, 2013

(86) PCT No.: PCT/FI2013/050127
§ 371 (c)(1),
(2) Date: Aug. 8, 2014

(87) PCT Pub. No.: WO2013/121091
PCT Pub. Date: Aug. 22, 2013

(65) Prior Publication Data

US 2015/0332615 A1 Nov. 19, 2015

(30) Foreign Application Priority Data

Feb. 14, 2012 (FI) ..... 20125166

(51) Int. Cl.
*G09F 3/20* (2006.01)

(52) U.S. Cl.
CPC ..... *G09F 3/204* (2013.01); *G09F 3/208* (2013.01)

(58) Field of Classification Search
CPC ..... G09F 3/204; G09F 3/208
See application file for complete search history.

(56) References Cited

U.S. PATENT DOCUMENTS

| | | | | |
|---|---|---|---|---|
| 5,470,138 | A * | 11/1995 | Kump | A47F 1/12 206/39.5 |
| 5,575,100 | A * | 11/1996 | Marvin | G09F 3/204 40/5 |
| 5,791,080 | A * | 8/1998 | Hamano | G09F 3/204 40/642.02 |
| 6,119,990 | A * | 9/2000 | Kump | A47F 5/0068 211/57.1 |
| 6,126,125 | A | 10/2000 | Dalton | |
| 6,367,752 | B1 | 4/2002 | Forsythe et al. | |
| 6,553,702 | B1 * | 4/2003 | Bacnik | G09F 3/204 40/649 |
| 6,604,310 | B1 * | 8/2003 | Lindstrom | A47F 5/0869 40/642.01 |
| 7,455,081 | B2 | 11/2008 | Bacnik | |
| 7,726,057 | B2 | 6/2010 | Brinkman et al. | |
| 2003/0111580 | A1 * | 6/2003 | Catteau | A47F 5/0869 248/222.51 |
| 2004/0178308 | A1 | 9/2004 | Bacnik | |
| 2007/0246532 | A1 | 10/2007 | Nunez et al. | |
| 2008/0282592 | A1 * | 11/2008 | Brinkman | G09F 3/204 40/661.03 |
| 2011/0102155 | A1 * | 5/2011 | Choi | G06Q 30/06 340/10.6 |

(Continued)

FOREIGN PATENT DOCUMENTS

| | | | |
|---|---|---|---|
| GB | 2469353 | A | 10/2010 |
| WO | WO 2006/087424 | A1 | 8/2006 |
| WO | 2008/077971 | A1 | 7/2008 |

(Continued)

*Primary Examiner* — Gary Hoge
(74) *Attorney, Agent, or Firm* — Birch, Stewart, Kolasch & Birch, LLP

(57) ABSTRACT

A fastening arrangement for an electronic price label includes a holder, into which the electronic price label is placed. The holder can in turn be fastened onto an installation point, such as onto the edge of a shelf. In the fastening arrangement the electronic price label is locked in relation to the holder with a fastening member, which extends through the wall of the holder from the first side of the wall to the second side of the wall and onwards into the electronic price label.

20 Claims, 3 Drawing Sheets

(56) References Cited

U.S. PATENT DOCUMENTS

| | | | | |
|---|---|---|---|---|
| 2012/0060399 | A1* | 3/2012 | Sjodln | G09F 3/208 40/655 |
| 2014/0158846 | A1* | 6/2014 | Nicolis | G09F 3/204 248/309.1 |

FOREIGN PATENT DOCUMENTS

| | | | |
|---|---|---|---|
| WO | 2009/019394 | A1 | 2/2009 |
| WO | WO 2009/103857 | A1 | 8/2009 |
| WO | 2010/107367 | A1 | 9/2010 |
| WO | WO 2010/107366 | A1 | 9/2010 |

* cited by examiner

FASTENING ARRANGEMENT FOR AN ELECTRONIC PRICE LABEL

FIELD OF THE INVENTION

The invention relates to electronic price label systems. The invention relates more particularly to a fastening arrangement for an electronic price label.

According to one embodiment of the invention the fastening arrangement according to the invention can be used e.g. in various electronic price labels that are provided with an electronic display. These types of displays comprise e.g. electronic displays for showing the price information of products and other product information in retail stores and warehouses.

BACKGROUND OF THE INVENTION

Conventionally the price information of price labels is changed manually when the price of a product changes. New price labels are printed onto paper or onto a corresponding material and these labels, with their new price markings, are manually disposed in locations reserved on shelves in sales premises. Consequently, an employee must first find the correct location for the price label to be updated, after which the previous price label is removed and discarded and the new price label is placed into position. One drawback, among others, in this arrangement is that the arrangement is very laborious and the risk of errors is high. In the case of an error, e.g. a situation can arise in which the price information of a price label on the shelves is at variance with the price information of the checkout system.

In order to avoid the drawbacks described above, electronic systems have been developed wherein electronic price labels and the electronic displays of them are placed on the front edge of shelves or above them near the products, wherein the price information of the products can be changed centrally from the control center or corresponding of the system. This enables and significantly speeds up the updating of price information. The information on the displays can be updated in a wireline or wireless manner, depending on the system.

Known from publication WO 2009/103857A1 is a system in which wireless electronic price labels are used. The properties of the wireless, layer-structured, electronic price labels presented in the publication are excellent. Some situations have arisen, however, in which a price label has not remained in the holder in the desired manner owing to external factors.

SUMMARY OF THE INVENTION

The aim of the invention is to reduce the aforementioned problems and to simultaneously enable an inexpensive and reliable fastening arrangement for an electronic price label.

The invention is based on a concept, wherein an electronic price label is locked in relation to the holder of the price label with a fastening means, which extends through the wall of the holder from the first side of it to the second side and onwards through the outer surface of the electronic price label into the price label.

The fastening arrangement according to the invention is characterized by what is stated in claim 1.

The embodiments of the fastening arrangement according to the invention are characterized by what is stated in claims 2-9.

The solution according to the invention has a number of important advantages. It has been unexpectedly observed that in the fastening arrangement for an electronic price label a fastening means can be applied for locking the price label in relation to the holder, which fastening means can at its simplest be pressed through the wall of the holder into the electronic price label. Since an electronic price label is a complex laminated layer structure, which can easily become defective due to the fastening means being arranged in the wrong point, the fastening point of it is preferably marked on the electronic price label. By using in the price label a prefabricated fastening point, comprising e.g. a cutting or countersinking or bore for the fastening means, the locking between the fastening means and the price label can be improved. By forming the tip of the fastening means to be tapering, even sharp, the penetration properties of the fastening means can be improved. In connection with pre-boring or countersinking, a blunt fastening means according to an embodiment of the invention can be used. Preferably an aperture can be formed in the wall of the holder for the fastening means in a suitable location, in which case the fastening point of the electronic price label and the aperture of the holder are most preferably face-to-face. The fastening point of the electronic price label is preferably formed in the rear surface of it, i.e. in the surface facing away from the display direction. In this case the fastening means remains behind the electronic price label concealed when seen from the ordinary main direction of viewing it. By arranging the holder to comprise a folding point or hinging between the fastening part of the holder and the holder part of the electronic price label, an installation position that facilitates placement of the fastening means is achieved for the holder.

DESCRIPTION OF THE FIGURES

In the following, the invention will be described in more detail by the aid of an example of its embodiment with reference to the attached drawings, wherein.

DETAILED DESCRIPTION OF THE INVENTION

Figure 1:
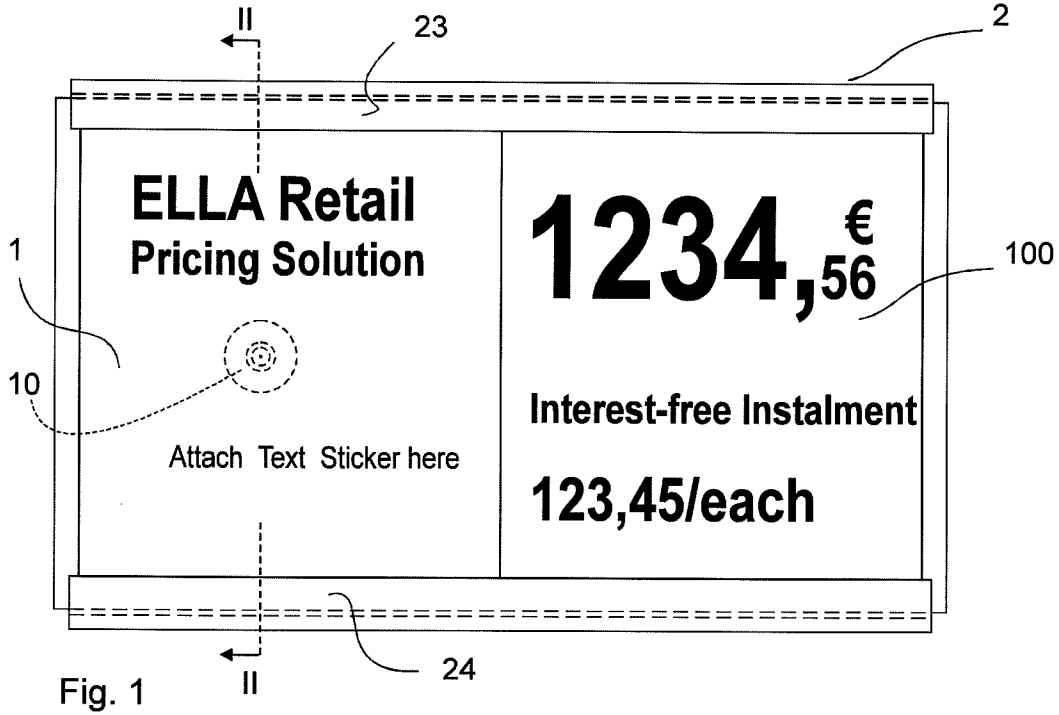
FIG. 1 presents a simplified electronic price label according to one embodiment of the invention from in front of the fastening arrangement.

FIG. 1 presents a diagrammatic and simplified front view of the combination of an electronic price label 1 according to the invention and its holder 2. The electronic price label, which is typically a laminate display, is arranged to display the price information and product information of a product, said product information including, inter alia, the name of the product and possibly other information relating to the product.

Each electronic laminate display, briefly a display, forms a thin price label, which is provided with display segments or with pixels and which resembles a price label of paper, on which display the required prices of products and other necessary symbols are formed by changing the colors of the segments or pixels of an essentially dichromatic display.

One layer of the display is e.g. an active ink layer. The ink layer contains a number of microcapsules, which are filled with a liquid and which contain e.g. essentially black particles, which have a positive surface charge and the location of which is controlled with an electrical field such that in the desired display segments the black particles are on, wherein the aforementioned display segment appears black when it is viewed from above, and in the other display segments white particles are on, wherein these display segments appear white when viewed from above. The background of the display is formed from the same microcapsules, in which e.g. price information can be displayed as dark numbers against a light background or, if so desired, vice versa. This type of display, which is used, can be an electrophoretic microcapsule display laminate described e.g. in Finnish patent application FI 20050192. Displays have been further developed and publication WO2009/103857A1 presents one electronic price label, the locking of which in relation to the holder can be arranged according to the present invention.

Figure 2:
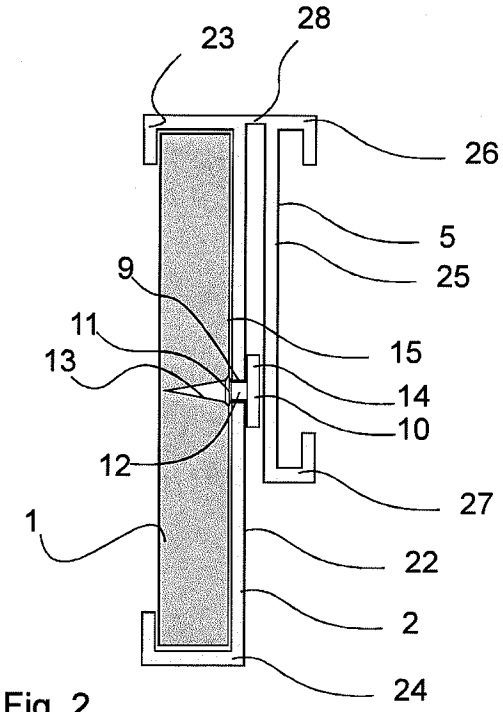
FIG. 2 presents a cross-section of an embodiment of the invention along the line II-II of FIG. 1.

FIGS. 1 and 2 present a fastening arrangement for an electronic price label 1, more particularly a shelf label, according to the invention. The electronic price label 1, which is referred to hereinafter with just the word "label", is arranged in a holder 2. The price label comprises a display 100, which is provided with display segments or with pixels and which resembles a price label of paper, on which display the required prices of products and other necessary symbols are formed by changing the colors of the segments or pixels of an essentially dichromatic display. In the embodiment of the figures the holder has a profile shape, more particularly a C-profile shape, in which case the label 1 is arranged into the space between the top part 23 and bottom part 24 of the profile, which parts are connected by a wall 22. In the figure, the fastening part 5 of the holder also has a profile shape, more particularly a C-profile, which is arranged back-to-back with the C-profile of the holder.

In the fastening arrangement for an electronic price label according to the invention, which fastening arrangement comprises a holder 2, into which the electronic price label 1 is placed, the holder can in turn be fastened onto an installation point, such as onto the edge of a shelf. In the fastening arrangement the electronic price label 1 is locked in relation to the holder 2 with a fastening means 10, which extends through the wall 22 of the holder 2 from the first side of the wall to the second side of the wall and onwards into the electronic price label 1.

In the embodiment of FIGS. 2-5 the fastening means 10 comprises a head part 14 and stem part 12, which stem part extends in the fastening position from the head part 14 through the wall 22 of the holder from the first side of it to the second side and onwards into the electronic price label 1.

The fastening means 10 is configured to penetrate the wall 15 of the price label 1. The wall 15 of the price label 1 in the figure is the wall on the side of the wall 22 of the holder.

According to one embodiment the placement point, from where the fastening means is pressed through the wall 15 of the price label, is marked on the wall 15 of the electronic price label 1. The placement point can be marked, e.g. by marking with printing ink, by painting, by printing, or by making in the wall a pre-cutting or perforation in the placement point.

According to one embodiment a detent part 11 is arranged on the stem part 12 of the fastening means 10. The detent part 11 is arranged to hold the fastening means 10 in relation to the price label in the fastening position.

Figure 5:
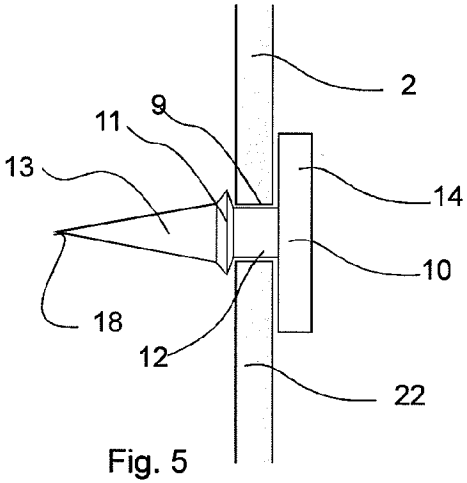
FIG. 5 presents a detail of an embodiment of the invention.

The detent part 11 according to the embodiment presented in FIGS. 2 and 5 is a protuberance formed on the stem part 12 of the fastening means 10. The fastening means 10 or at least the detent part 11 can be material that is to some extent compressible, in which case the detent part compresses to some extent when placing it into the locking position from the aperture 9 of the holder and/or into the wall 15 of the price label. The detent part is in the fastening position, FIGS. 2, 3, 5, arranged at such a distance from the head part 14 of the fastening means 10 that in the fastening position it is on a different side of the wall 22 of the holder 2 than the head part 14. According to one embodiment in the fastening position the detent part 11 is inside, at least partly, the price label with respect to the plane of the wall 15 of the price label 1.

On the other hand the fastening means can be formed as a stud part, in which case it is intended to penetrate at least the wall of the price label when arranging it into the locking position. The opposite section 13 of the stem part 12 of the fastening means with respect to the head part 14, i.e. the tip section, is formed to taper towards the free end 18, i.e. towards the tip. A tapering tip section facilitates placement of the fastening means into the fastening position.

Figure 7:
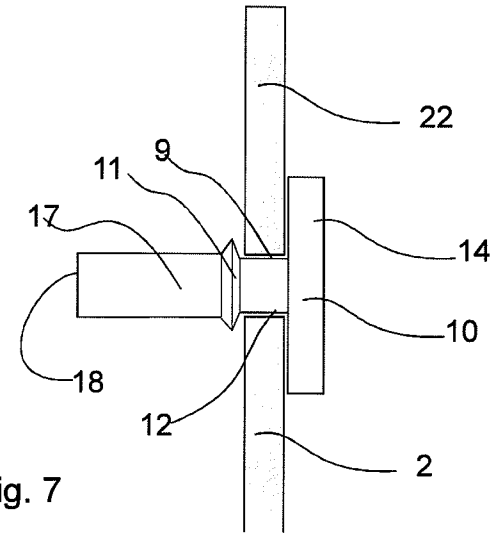
FIG. 7 presents a detail of the embodiment of a fastening means according to FIG. 6.
Figure 6:
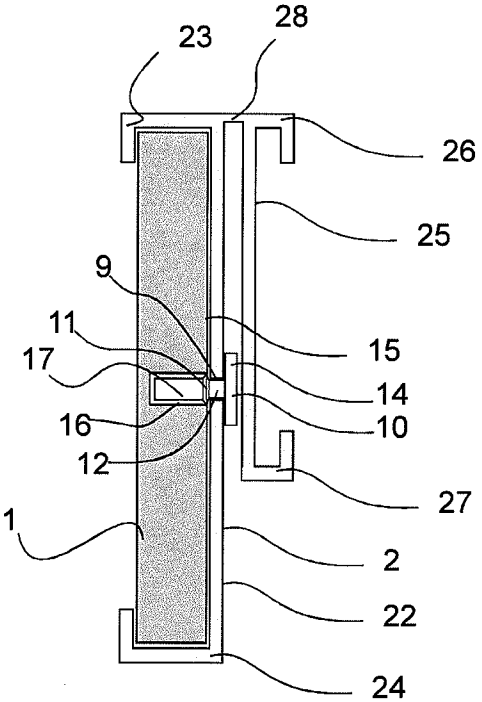
FIG. 6 presents a cross-section of a second embodiment of the invention.

FIGS. 6 and 7 present a second embodiment of the invention. A bore 16 or corresponding cavity is formed in the electronic price label 1, in the wall part 15 of it, into which bore at least a part 13, 17 of the stem part 12 of the fastening means is fitted in the locking position.

In the embodiment according to FIGS. 6 and 7, the stem part of the fastening means is formed to be blunt at its free end 18, in which case the opposite section 17 with respect to the head part 14 can be formed to be almost straight, such as to be cylindrical or, e.g. for reasons due to manufacturing technique, to be of a slightly tapered and truncated shape narrowing towards the free end 18.

Figure 4:
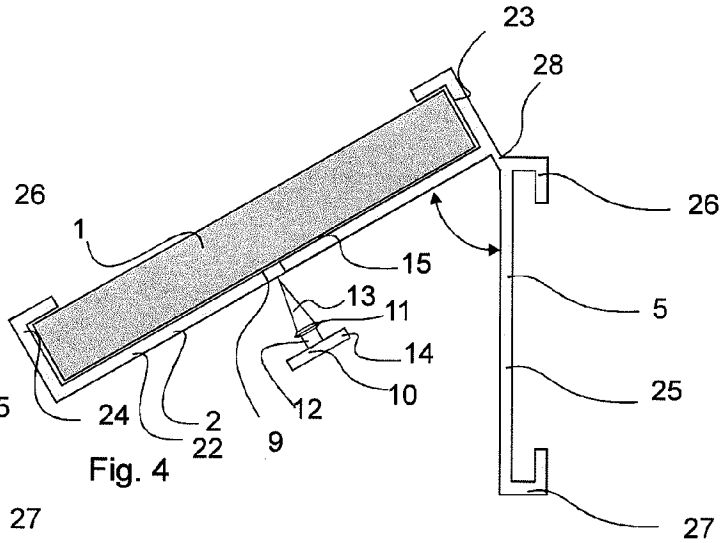
FIG. 4 presents a cross-section of an embodiment of the invention before the installation of the fastening means.
Figure 3:
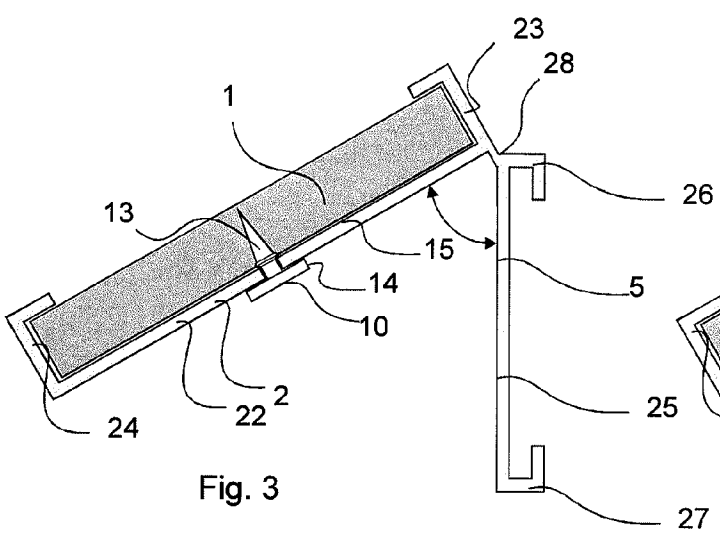
FIG. 3 presents a cross-section of an embodiment of the invention in the installation position of the fastening means.

FIGS. 2, 3 and 4 further present an embodiment of a holder, the aim of which is to facilitate the placement of the fastening means 10 into the fastening position and/or the detachment of the fastening means from the fastening position. The holder comprises a fastening part 5, from which it can be fastened onto its installation point, in which case a flexible neck or hinge point 28 is arranged between the fastening part 5 and the holder part 2 of the price label such that the holder part 2 can be turned at the point of the flexible neck 28 or hinge point in relation to the fastening part 5.

When it is desired to install the fastening means 10, the holder 2 is turned into the position of FIG. 4, in which the holder part 2 is turned at the hinge point 28 away from the fastening part 5. In the figure, a double arrow describes the movement directions. After this the fastening means can be pressed tip part 13 first through the aperture 9 of the holder, and onwards through the wall 15 of the electronic price label in the holder, into the fastening position, which is presented in FIG. 3. The detent part 11 keeps the fastening means 10 in its position in relation to the holder 1 and/or the price label 1.

When the electronic price label 1 is locked with the fastening means 10 to the holder 2, the holder can be turned at the hinge point 28 in relation to the fastening part 5 into the normal display position, which is presented in FIG. 1.

When it is desired to disassemble the locking, the procedure can be followed in the reverse sequence. The holder is turned into the position of FIG. 3. After this the fastening means is removed, if necessary by using a tool, in which case in the situation of FIG. 4 the electronic price label 1 can be removed from the space between the wall 22 of the holder and the top part 23 and the bottom part 24.

With the fastening arrangement according to the invention effective locking of the price label is achieved. The electronic price label cannot in this case be easily stolen or displaced. According to the invention a fastening means, such as a stud, is pressed into the rear of the price label into a point at which it does not damage the label. The fastening means, such as a stud, is pushed into the rear of the price label holder 2 through the wall 22 (which is e.g. plastic) and onwards into the price label 1. The length of the fastening means 10, such as a stud, is configured to be such that the fastening means does not extend through the price label 1. The point from where the fastening means can be pressed in is preferably marked on the label. A pre-bored hole 9 can be formed in the holder of the label for facilitating the pressing of the fastening means. A hole/countersink can also be made in the price label 1, especially if the material is hard. The fastening means, such as a stud, has a detent means, such as a collar, with which the fastening means locks when it is in the fastening position. In this case the fastening means cannot easily be removed. The fastening means is preferably formed from a material that in the fastening position does not essentially interfere with the wireless data transfer of the electronic price label. Many materials can be used as a material, e.g. plastic.

The product shelves in a retail store are usually provided with a fastening part, such as with a shelf rail, into which the holder 2 of the electronic price label can be arranged from its fastening part 5, which in the figures comprises counterparts 26, 27 for the fastening part of the edge of the product shelf. The electronic price labels 1, which are provided with e.g. electrophoretic laminate displays and with product information, are placed into locations on the shelves that correspond to the products. Also other types of solutions can be applied in connection with the fastening arrangement of the invention in arranging a holder into connection with a product shelf or corresponding.

It is obvious to the person skilled in the art that the invention is not limited to the embodiments presented above, but that it can be varied within the scope of the claims presented below. The characteristic features presented in the description mentioned in conjunction with each other can also be independent characteristic features.

The invention claimed is:

1. A fastening arrangement for an electronic price label, comprising:

a holder, into which the electronic price label is placed, which holder can in turn be fastened onto an installation point, wherein the electronic price label is locked in relation to the holder with a fastener, which extends through a wall of the holder from a first side of the wall to a second side of the wall and into the electronic price label.

2. The fastening arrangement for an electronic price label according to claim 1, wherein the fastener comprises a head part and a stem part, which stem part extends in a fastening position from the head part through the wall of the holder from the first side of it to the second side and onwards into the electronic price label.

3. The fastening arrangement for an electronic price label according to claim 1, wherein the fastener is configured to penetrate a wall of the electronic price label.

4. The fastening arrangement for an electronic price label according to claim 1, wherein a placement point of the fastener is marked on a wall of the electronic price label.

5. The fastening arrangement for an electronic price label according to claim 1, wherein a bore or corresponding cavity is formed in the electronic price label, into which bore at least a part of a stem part of the fastener is fitted in the locking position.

6. The fastening arrangement for an electronic price label according to claim 1, wherein the holder comprises a fastening part, and a flexible neck or hinge point is point arranged between the fastening part and a holder part of the price label such that the holder part can be turned at the flexible neck or hinge point in relation to the fastening part.

7. The fastening arrangement for an electronic price label according to claim 3, wherein a placement point of the fastener is marked on the wall of the electronic price label.

8. The fastening arrangement for an electronic price label according to claim 3, wherein the fastener comprises a head part and a stem part, and wherein a detent part is arranged on the stem part of the fastener.

9. The fastening arrangement for an electronic price label according to claim 8, wherein the detent part is a protuberance formed on the stem part.

10. The fastening arrangement for an electronic price label according to claim 4, wherein the fastener comprises a head part and a stem part, and wherein a detent part is arranged on the stem part of the fastener.

11. The fastening arrangement for an electronic price label according to claim 10, wherein the fastener comprises a head part and a stem part, and wherein the detent part is a protuberance formed on the stem part.

12. The fastening arrangement for an electronic price label according to claim 2, wherein a detent part is arranged on the stem part of the fastener.

13. The fastening arrangement for an electronic price label according to claim 12, wherein the detent part is a protuberance formed on the stem part.

14. The fastening arrangement for an electronic price label according to claim 2, wherein an opposite section of the stem part with respect to the head part is formed to taper towards a tip.

15. The fastening arrangement for an electronic price label according to claim 2, wherein the fastener is configured to penetrate a wall of the electronic price label.

16. The fastening arrangement for an electronic price label according to claim 15, wherein the fastener comprises a head part and a stem part, and wherein a detent part is arranged on the stem part of the fastener.

17. The fastening arrangement for an electronic price label according to claim 16, wherein the fastener comprises a head part and a stem part, and wherein the detent part is a protuberance formed on the stem part.

18. The fastening arrangement for an electronic price label according to claim 2, wherein a placement point of the fastener is marked on a wall of the electronic price label.

19. The fastening arrangement for an electronic price label according to claim 18, wherein a detent part is arranged on the stem part of the fastener, and wherein the detent part is a protuberance formed on the stem part.

20. The fastening arrangement for an electronic price label according to claim 2, wherein the opposite section of the stem part with respect to the head part is formed to taper towards the tip.

* * * * *